US008955840B2

(12) United States Patent
Shimazu

(10) Patent No.: US 8,955,840 B2
(45) Date of Patent: Feb. 17, 2015

(54) PAPER SHEET CONVEYING APPARATUS AND IMAGE FORMING APPARATUS

(71) Applicant: KYOCERA Document Solutions Inc., Osaka-shi, Osaka (JP)

(72) Inventor: Kozo Shimazu, Osaka (JP)

(73) Assignee: KYOCERA Document Solutions, Inc., Osaka-shi (JP)

( * ) Notice: Subject to any disclaimer, the term of this patent is extended or adjusted under 35 U.S.C. 154(b) by 0 days.

(21) Appl. No.: 13/968,275

(22) Filed: Aug. 15, 2013

(65) Prior Publication Data

US 2014/0061995 A1 Mar. 6, 2014

(30) Foreign Application Priority Data

Aug. 28, 2012 (JP) ..... 2012-188108

(51) Int. Cl.

| | |
|---|---|
| ***B65H 7/02*** | (2006.01) |
| ***B65H 7/06*** | (2006.01) |
| ***B65H 29/62*** | (2006.01) |
| ***B65H 5/06*** | (2006.01) |
| ***B65H 5/26*** | (2006.01) |
| ***G03G 15/00*** | (2006.01) |

(52) U.S. Cl.

CPC ..... *B65H 7/06* (2013.01); *B65H 29/62* (2013.01); *B65H 5/062* (2013.01); *B65H 5/26* (2013.01); *G03G 15/55* (2013.01); *G03G 15/6529* (2013.01); *G03G 15/70* (2013.01); *B65H 2511/242* (2013.01); *B65H 2511/522* (2013.01); *B65H 2511/524* (2013.01); *B65H 2511/528* (2013.01); *B65H 2513/412* (2013.01); *B65H 2513/42* (2013.01); *B65H 2515/82* (2013.01); *B65H 2557/23* (2013.01); *B65H 2557/242* (2013.01); *B65H 2801/06* (2013.01); *G03G 2215/00637* (2013.01)

USPC ..... 271/258.01; 271/258.02; 271/258.04; 271/265.01

(58) Field of Classification Search

USPC ..... 271/256, 258.01, 262, 263, 258.02, 271/258.04, 265.01, 265.02, 265.04

See application file for complete search history.

(56) References Cited

U.S. PATENT DOCUMENTS 3,603,680 A * 9/1971 Barton ..... 399/21
6,520,498 B2 * 2/2003 Phinney ..... 271/263

(Continued)

FOREIGN PATENT DOCUMENTS

JP 2006317822 A 11/2006

*Primary Examiner* — Ernesto Suarez

(74) *Attorney, Agent, or Firm* — Alleman Hall McCoy Russell & Tuttle LLP

(57) ABSTRACT

A paper sheet conveying apparatus includes a paper sheet conveyance path, a conveyance sound detection portion, an abnormality correspondence information storage portion, and an abnormality specifying portion. The conveyance sound detection portion detects conveyance sound of a paper sheet on the paper sheet conveyance path. The abnormality correspondence information storage portion has stored therein abnormality correspondence information indicating correspondence relationships between contents of a plurality of types of sheet conveyance abnormalities that can occur on the paper sheet conveyance path, and contents of the conveyance sounds detected by the conveyance sound detection portion when the respective sheet conveyance abnormalities occur. The abnormality specifying portion specifies the content of the sheet conveyance abnormality that has occurred on the paper sheet conveyance path, in accordance with the abnormality correspondence information stored in the abnormality correspondence information storage portion and the conveyance sound detected by the conveyance sound detection portion.

13 Claims, 4 Drawing Sheets

(56) References Cited

U.S. PATENT DOCUMENTS 7,502,570 B2 * 3/2009 Nishimura ..... 399/8
8,585,050 B2 * 11/2013 Syracuse et al. ..... 271/258.01
2010/0295241 A1 * 11/2010 Isogai ..... 271/227
2012/0235929 A1 * 9/2012 Hongo et al. ..... 345/173
2013/0140757 A1 * 6/2013 Phinney et al. ..... 271/10.01
2014/0062008 A1 * 3/2014 Hongo et al. ..... 271/258.01

* cited by examiner

PAPER SHEET CONVEYING APPARATUS AND IMAGE FORMING APPARATUS

INCORPORATION BY REFERENCE

This application is based upon and claims the benefit of priority from the corresponding Japanese Patent Application No. 2012-188108 filed on Aug. 28, 2012, the entire contents of which are incorporated herein by reference.

BACKGROUND

The present disclosure relates to a paper sheet conveying apparatus and an image forming apparatus.

An image forming apparatus such as a printer, a facsimile apparatus, a copy machine, and a multifunction peripheral is provided with a paper sheet conveying apparatus which conveys a paper sheet. The paper sheet conveying apparatus conveys a paper sheet by rotating a plurality of conveying roller pairs which hold a paper sheet, for example. Specifically, in the image forming apparatus, the paper sheet conveying apparatus is used for conveying paper sheets stacked on a sheet feed cassette, a manual feed tray, or the like to an image forming portion.

Generally, a sheet conveyance abnormality caused during conveyance of a paper sheet, such as a stuffed state with a paper sheet on a paper sheet conveyance path through which a paper sheet is conveyed, is called as jam. In addition, for example, a detection method (hereinafter, referred to as a "conventional method") for jam which detects occurrence of jam in accordance with a sheet pass timing detected by a paper sheet detection sensor provided on the paper sheet conveyance path is conventionally known.

In addition, a technique of collecting sound caused when a paper sheet is separated from a fixing roller and preventing, based on the sound, occurrence of jam due to winding of a paper sheet on the fixing roller, is known.

SUMMARY

A paper sheet conveying apparatus according to one aspect of the present disclosure includes a paper sheet conveyance path, a conveyance sound detection portion, an abnormality correspondence information storage portion, and an abnormality specifying portion. On the paper sheet conveyance path, a paper sheet is conveyed. The conveyance sound detection portion detects conveyance sound of a paper sheet on the paper sheet conveyance path. The abnormality correspondence information storage portion has stored therein abnormality correspondence information indicating correspondence relationships between contents of a plurality of types of sheet conveyance abnormalities that can occur on the paper sheet conveyance path, and contents of the conveyance sounds detected by the conveyance sound detection portion when the respective sheet conveyance abnormalities occur. The abnormality specifying portion specifies the content of the sheet conveyance abnormality that has occurred on the paper sheet conveyance path, in accordance with the abnormality correspondence information stored in the abnormality correspondence information storage portion and the conveyance sound detected by the conveyance sound detection portion.

An image forming apparatus according to another aspect of the present disclosure includes a paper sheet conveyance path, a conveyance sound detection portion, an abnormality correspondence information storage portion, an abnormality specifying portion, and an image forming portion. On the paper sheet conveyance path, a paper sheet is conveyed. The conveyance sound detection portion detects conveyance sound of a paper sheet on the paper sheet conveyance path. The abnormality correspondence information storage portion has stored therein abnormality correspondence information indicating correspondence relationships between contents of a plurality of types of sheet conveyance abnormalities that can occur on the paper sheet conveyance path, and contents of the conveyance sounds detected by the conveyance sound detection portion when the respective sheet conveyance abnormalities occur. The abnormality specifying portion specifies the content of the sheet conveyance abnormality that has occurred on the paper sheet conveyance path, in accordance with the abnormality correspondence information stored in the abnormality correspondence information storage portion and the conveyance sound detected by the conveyance sound detection portion. The image forming portion forms an image on a paper sheet fed from the paper sheet conveyance path.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

<Schematic Configuration of Multifunction Peripheral 10>

Figure 1A:
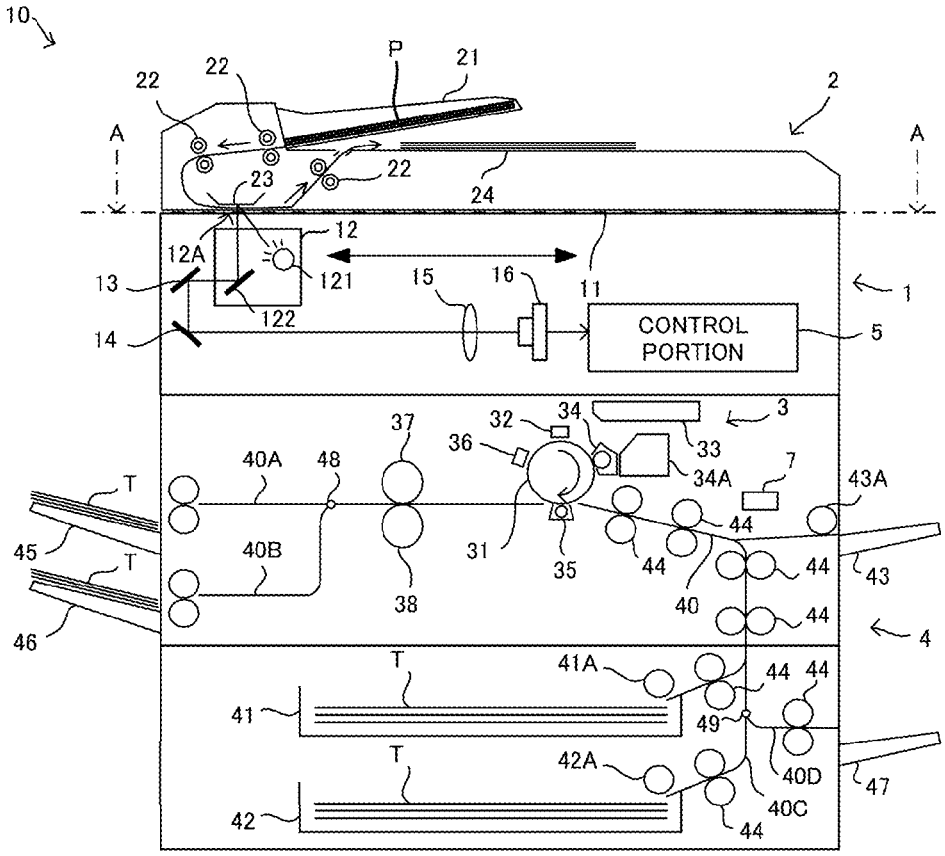
FIGS. 1A and 1B are schematic configuration diagram of a multifunction peripheral according to an embodiment of the present disclosure.
Figure 1B:
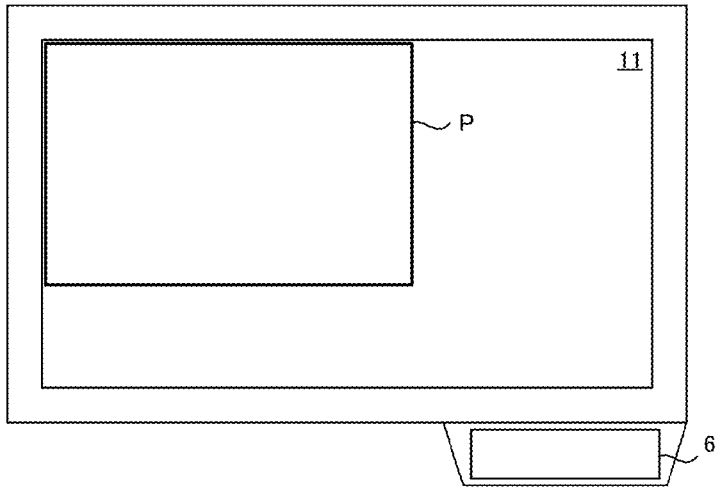

First, with reference to FIGS. 1A and 1B, the schematic configuration of a multifunction peripheral 10 according to an embodiment of the present disclosure will be described. It is noted that FIG. 1A is a schematic sectional view of the multifunction peripheral 10 and FIG. 1B is a view as seen from the direction of arrows A in FIG. 1A.

The multifunction peripheral 10 is an image forming apparatus including an image reading portion 1, an ADF 2, an image forming portion 3, a sheet feed portion 4, a control portion 5, an operation display portion 6, a sound collecting microphone 7, and the like. It is noted that the multifunction peripheral 10 is merely an example of an image forming apparatus according to the present disclosure. In addition, an apparatus including the sheet feed portion 4 and the control portion 5 corresponds to a paper sheet conveying apparatus according to the present disclosure.

The image reading portion 1 includes a contact glass 11, a reading unit 12, mirrors 13 and 14, an optical lens 15, a CCD (Charge Coupled Device) 16, and the like. The contact glass 11 is provided on the upper surface of the image reading portion 1, and is a transparent document table on which a document sheet P is placed as an image reading target of the multifunction peripheral 10. The image reading portion 1 reads image data from the document sheet P placed on the contact glass 11, by being controlled by the control portion 5.

The reading unit 12 includes an LED light source 121 and a mirror 122. The reading unit 12 can be moved in a secondary scanning direction in FIG. 1A by a drive motor. When the reading unit 12 is moved in the secondary scanning direction by the drive motor, scanning in the secondary scanning direction is performed with light radiated onto the contact glass 11 from the LED light source 121.

The LED light source 121 includes multiple white LEDs arranged along a primary scanning direction in FIG. 1A. The LED light source 121 radiates one line of white light toward a portion of the document sheet P at a reading position 12A on the contact glass 11.

The mirror 122 reflects, toward the mirror 13, light reflected when light is radiated from the LED light source 121 to the portion of the document sheet P at the reading position 12A. The light reflected from the mirror 122 is guided to the optical lens 15 by the mirrors 13 and 14. The optical lens 15 concentrates the light entering thereto and causes the concentrated light to enter the CCD 16.

The CCD 16 is a photoelectric conversion element that converts the received light into a voltage corresponding to the light amount thereof and outputs the conversion result as image data.

The ADF 2 is an automatic document feeder including a document sheet set portion 21, a plurality of conveying rollers 22, a document sheet holding portion 23, a sheet discharge portion 24, and the like. The ADF 2 is supported by a housing of the multifunction peripheral 10 in an openable and closable fashion with respect to the contact glass 11.

The ADF 2 drives each of the conveying rollers 22. Then, the document sheet P set on the document sheet set portion 21 is conveyed through the reading position 12A on the contact glass 11 to the sheet discharge portion 24. At this time, the image reading portion 1 reads image data from the document sheet P passing through the reading position 12A.

The document sheet holding portion 23 is provided above the reading position 12A on the contact glass 11, with an interval provided therebetween so as to allow the document sheet P to pass. The document sheet holding portion 23 has a shape elongated in the primary scanning direction, and has a white sheet pasted on its lower surface (the surface on the contact glass 11 side). In the multifunction peripheral 10, image data of the white sheet is read as white reference data.

The image forming portion 3 is an image forming portion that executes image forming processing (printing processing) based on image data read by the image reading portion 1 or image data inputted from a personal computer.

Specifically, the image forming portion 3 includes a photosensitive drum 31, a charging device 32, an LSU 33, a developing device 34, a transfer roller 35, an electricity removing device 36, a fixing roller 37, a pressure roller 38, and the like. In the image forming portion 3, an image is formed on a paper sheet T fed from the sheet feed portion 4 by the following procedure, and the paper sheet T having an image formed thereon is discharged to a later-described sheet discharge tray 45 or 46 selected in advance.

First, the photosensitive drum 31 is uniformly charged at a predetermined potential. Next, light based on image data is radiated to the surface of the photosensitive drum 31 by the LSU 33. Thus, an electrostatic latent image is formed on the surface of the photosensitive drum 31. Then, the electrostatic latent image on the photosensitive drum 31 is developed (visualized) as a toner image by the developing device 34. It is noted that a toner is fed from a detachable toner container 34A to the developing device 34. Subsequently, the toner image formed on the photosensitive drum 31 is transferred onto a paper sheet T by the transfer roller 35. Thereafter, the toner image transferred onto the paper sheet T is melted and fixed by being heated by the fixing roller 37 when the paper sheet T passes between the fixing roller 37 and the pressure roller 38. It is noted that the potential of the photosensitive drum 31 is removed by the electricity removing device 36.

The sheet feed portion 4 includes a paper sheet conveyance path 40, sheet feed cassettes 41 and 42, a manual feed tray 43, a plurality of conveying rollers 44, sheet discharge trays 45 and 46, a jam sheet discharge tray 47, conveyance switching portions 48 and 49, and the like. By control from the control portion 5, the sheet feed portion 4 passes a paper sheet T contained in the sheet feed cassette 41 or 42 or a paper sheet T placed on the manual feed tray 43 through the image forming portion 3, and conveys the paper sheet T to the sheet discharge tray 45 or 46.

The paper sheet conveyance path 40 starts from the sheet feed cassette 41 or 42 or the manual feed tray 43, passes through the image forming portion 3, and leads to the sheet discharge tray 45 or 46, and is a paper sheet conveyance path through which a paper sheet T is conveyed by each conveying roller 44.

For the sheet feed cassettes 41 and 42, pickup rollers 41A and 42A are respectively provided. In addition, for the manual feed tray 43, a pickup roller 43A which is driven by a drive motor (not shown) is provided. The pickup roller 43A takes out a paper sheet T from the manual feed tray 43.

The plurality of conveying rollers 44 is linked with a drive motor drive-controlled by the control portion 5, via a drive transmission portion such as a gear. The plurality of conveying rollers 44 holding a paper sheet T is rotationally driven along with a forward or reverse rotation of the drive motor, thereby conveying the paper sheet T in either direction on the paper sheet conveyance path 40. It is noted that the photosensitive drum 31, the transfer roller 35, the fixing roller 37, the pressure roller 38, and the like of the image forming portion 3 also form a part of the paper sheet conveyance path 40 which conveys a paper sheet T. Hereinafter, driving of the conveying rollers 44 when a paper sheet T is conveyed from the sheet feed cassette 41 or 42 or the manual feed tray 43 to the sheet discharge tray 45 or 46 is referred to as forward driving, and driving of the conveying rollers 44 when a paper sheet T is conveyed in the opposite direction is referred to as reverse driving.

Each of the sheet discharge trays 45 and 46 is a discharge destination of a paper sheet T having an image formed thereon by the image forming portion 3. Specifically, the paper sheet conveyance path 40 includes a conveyance path 40A branching at the conveyance switching portion 48 and leading to the sheet discharge tray 45, and a conveyance path 40B branching at the conveyance switching portion 48 and leading to the sheet discharge tray 46. The conveyance destination of a paper sheet T on the paper sheet conveyance path 40 having an image formed thereon by the image forming portion 3 is switched to the conveyance path 40A or the conveyance path 40B by the conveyance switching portion 48. The conveyance switching portion 48 includes a drive portion and a nail member. The drive portion is a solenoid drive-controlled by the control portion 5, for example. The nail member is operated by the drive portion, to switch the conveyance destination of a paper sheet T to the conveyance path 40A or the conveyance path 40B.

The jam sheet discharge tray 47 is a dedicated tray as the discharge destination of a paper sheet T when jam has occurred on the paper sheet conveyance path 40. Specifically, the paper sheet conveyance path 40 includes a conveyance path 40C branching at the conveyance switching portion 49 and leading to the sheet feed cassette 42, and a conveyance path 40D branching at the conveyance switching portion 49 and leading to the jam sheet discharge tray 47. The conveyance destination of a paper sheet T on the paper sheet conveyance path 40 when the conveying rollers 44 are reversely driven is switched to the conveyance path 40C or the conveyance path 40D by the conveyance switching portion 49. The conveyance switching portion 49 includes a drive portion and a nail member, as in the conveyance switching portion 48. The drive portion is a solenoid or the like drive-controlled by the control portion 5, for example. The nail member is operated by the drive portion, to switch the conveyance destination of a paper sheet T to the conveyance path 40C or the conveyance path 40D.

The sound collecting microphone 7 is provided in the vicinity of the paper sheet conveyance path 40. The sound collecting microphone 7 is a conveyance sound detection portion that detects conveyance sound of a paper sheet T on the paper sheet conveyance path 40. The conveyance sound detected by the sound collecting microphone 7 is inputted to the control portion 5. It is noted that the providing position of the sound collecting microphone 7 shown in FIG. 1 is merely an example, and may be another position that allows detection of conveyance sound of a paper sheet T on the paper sheet conveyance path 40. In addition, in the present embodiment, the case where the sound collecting microphone 7 is provided at one position in the vicinity of the paper sheet conveyance path 40 will be described as an example. On the other hand, it is conceivable as another embodiment that a plurality of the sound collecting microphones 7 are provided around the paper sheet conveyance path 40.

In the multifunction peripheral 10 according to the present embodiment, paper sheet conveyance processing (see a flowchart in FIG. 3) described later is executed by the control portion 5. By this process, the type of jam (sheet conveyance abnormality) caused on the paper sheet conveyance path 40 is specified based on conveyance sound detected by the sound collecting microphone 7. It is noted that the contents of jams include one or more of deformation of a paper sheet T into a corrugated shape, oblique conveyance of a paper sheet T, occurrence of folded portion on a paper sheet T, tear of a paper sheet T, conveyance of paper sheets T in an overlapping manner, and occurrence of sliding of a paper sheet T.

Figure 2:
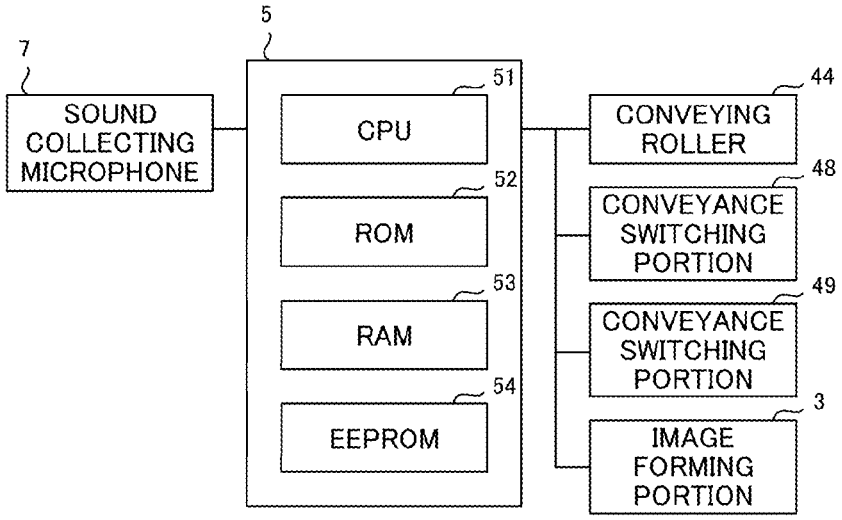
FIG. 2 is a block diagram showing a part of a system configuration of the multifunction peripheral according to an embodiment of the present disclosure.

Here, FIG. 2 is a block diagram showing a part of the system configuration of the multifunction peripheral 10.

As shown in FIG. 2, the control portion 5 includes control devices such as a CPU 51, a ROM 52, a RAM 53, and an EEPROM 54. The control portion 5 executes a predetermined control program stored in the ROM 52, by the CPU 51, thereby performing overall control for the multifunction peripheral 10. For example, the CPU 51 controls the operation of each constituent element such as the conveying roller 44, the conveyance switching portion 48, the conveyance switching portion 49, and the image forming portion 3. In addition, the RAM 53 is a volatile storage portion and the EEPROM 54 is a nonvolatile storage portion, and they are used as temporary storage portions for various processes executed by the CPU 51, for example.

In addition, the ROM 52 has stored therein in advance a paper sheet conveyance program that causes a computer such as the CPU 51 to execute the paper sheet conveyance processing (see the flowchart in FIG. 3) described below.

<Paper Sheet Conveyance Processing>

Figure 3:
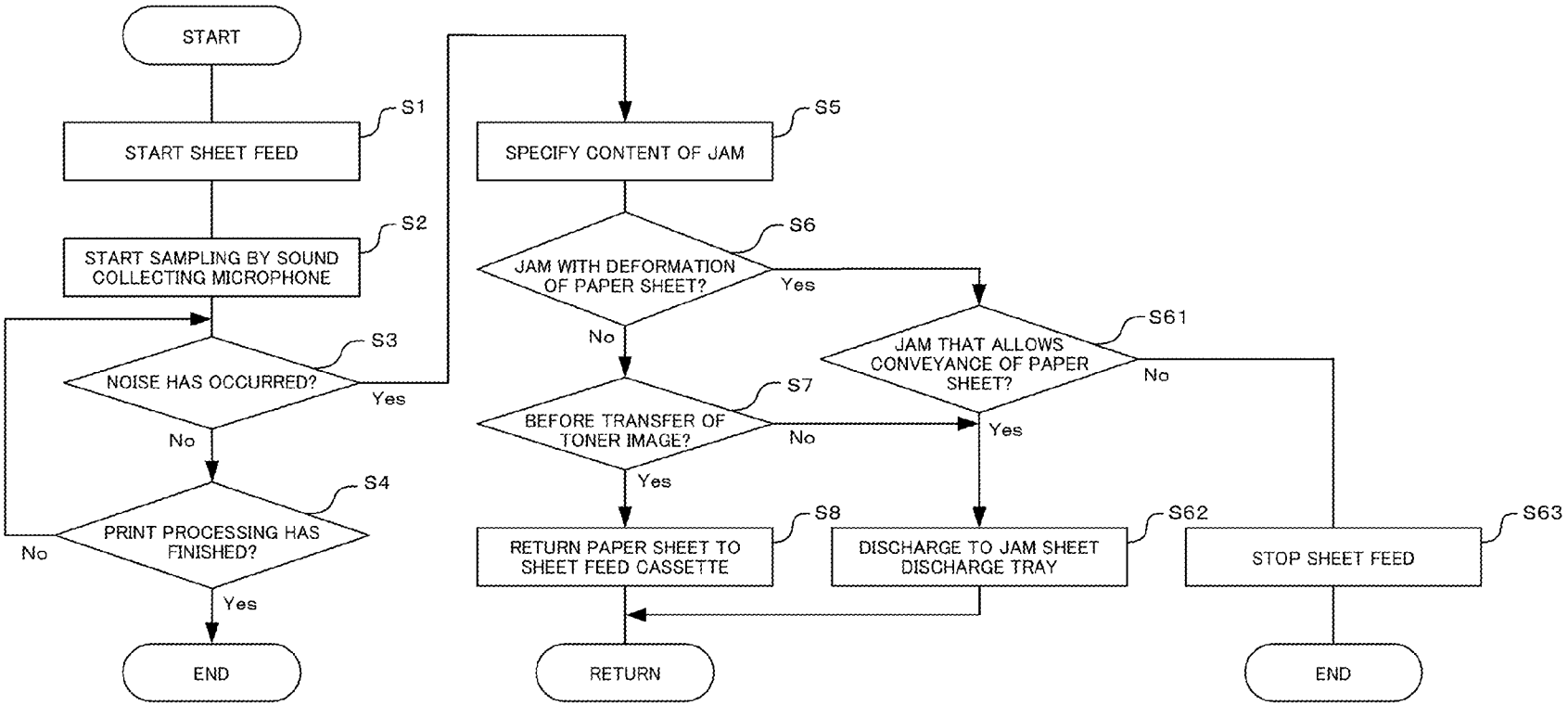
FIG. 3 is a flowchart for explaining an example of the procedure of paper sheet conveyance processing according to an embodiment of the present disclosure.

Hereinafter, with reference to FIG. 3, an example of a procedure of the paper sheet conveyance processing executed by the CPU 51 will be described. Here, steps S1, S2, . . . denote identification numbers of process steps executed by the CPU 51. It is noted that the present disclosure may be understood as disclosure of a method for executing each process step of the paper sheet conveyance processing in the multifunction peripheral 10, a program for causing a computer such as the CPU 51 to execute each process step of the paper sheet conveyance processing, or a computer-readable storage medium having stored therein the program.

The paper sheet conveyance processing is executed by the CPU 51 when a job request for image forming processing such as print processing or copy processing has been accepted based on an operation input to the operation display portion 6 from a user or reception of an operation signal from an information processing apparatus such as an external personal computer. Here, the job request includes sheet feed setting information about the feed source (the sheet feed cassette 41, the sheet feed cassette 42, or the manual feed tray 43) and the discharge destination (the sheet discharge tray 45 or the sheet discharge tray 46) of a paper sheet T for the image forming processing. In the case where the job request does not include the sheet feed setting information, the CPU 51 sets the sheet feed cassette 41 as the feed source and the sheet discharge tray 45 as the discharge destination, based on an initial setting set in advance. It is noted that the CPU 51 executes processing such as image forming processing of forming an image on a paper sheet T by controlling the image forming portion 3, in parallel with the paper sheet conveyance processing, but the description thereof is omitted here.

[Step S1]

First, in step S1, the CPU 51 drives the pickup roller 41A, 42A, or 43A, and forward drives the conveying roller 44. Thus, in the sheet feed portion 4, conveyance of a sheet T from the sheet feed cassette 41, the sheet feed cassette 42, or the manual feed tray 43 to the image forming portion 3 is started.

[Step S2]

In step S2, the CPU 51 starts sampling conveyance sound of the paper sheet T caused on the paper sheet conveyance path 40, by driving the sound collecting microphone 7. It is noted that the CPU 51 sequentially stores sampling data of the conveyance sound detected by the sound collecting microphone 7 into the RAM 53 or the EEPROM 54. Hereinafter, the sampling data is referred to as sound collection data. The sound collection data is, for example, the volume, the waveform, or a result of Fourier transform of the conveyance sound.

[Step S3]

In step S3, the CPU 51 determines whether or not noise that does not occur when a paper sheet T is normally conveyed on the paper sheet conveyance path 40 has occurred, based on the sound collection data.

Specifically, the EEPROM 54 has stored therein, in advance, normal conveyance sound data relevant to conveyance sound caused when a paper sheet T is normally conveyed on the paper sheet conveyance path 40. For example, the normal conveyance sound data is the volume, the waveform, or a result of Fourier transform of the conveyance sound caused when a paper sheet T is normally conveyed on the paper sheet conveyance path 40. The CPU 51 sequentially compares the sound collection data with the normal conveyance sound data, thereby determining whether or not noise is included in the sound collection data.

For example, if the volume of the sound collection data is greater than the volume of the normal conveyance sound data by a predetermined amount or more, the CPU 51 can determine that noise has occurred. In addition, it is conceivable that, on such a condition that the waveform of the sound collection data has deviated from that of the normal conveyance sound data by a predetermined amount or more, or sound with a specific frequency that is not included in the normal conveyance data is included in the sound collection data, the CPU 51 determines that noise has occurred. Further, it is conceivable that, on the condition that the volume of the sound collection data is equal to or greater than a predetermined upper limit volume, the CPU 51 determines that noise has occurred. It is noted that these detection methods are merely examples.

Here, it is conceivable that the CPU 51 updates the normal conveyance sound data stored in the EEPROM 54, based on the sound collection data detected by the sound collecting microphone 7 when a paper sheet T is normally conveyed on the paper sheet conveyance path 40 in the multifunction peripheral 10. For example, it is conceivable that the CPU 51 has a learning function of overwriting the normal conveyance sound data stored in the EEPROM 54, using the sound collection data as new normal conveyance sound data. Thus, the CPU 51 can determine accurately whether or not the noise has occurred, in spite of increase in the conveyance sound due to aging deterioration of the multifunction peripheral 10 or the environmental sound at an actual usage place of the multifunction peripheral 10.

Here, if the CPU 51 has determined that the noise has not occurred (No in S3), the CPU 51 shifts the process to step S4. On the other hand, if the CPU 51 has determined that the noise has occurred (Yes in S3), the CPU 51 shifts the process to step S5.

[Step S4]

In step S4, the CPU 51 determines whether or not the image forming processing requested by the job request has finished. Here, if the CPU 51 has determined that the entire image forming processing has not finished (No in S4), the CPU 51 returns the process to step S3. On the other hand, if the CPU 51 has determined the entire image forming processing has finished (Yes in S4), the CPU 51 ends sampling of the sound collection data and ends the paper sheet conveyance processing.

[Step S5]

In step S5, the CPU 51 specifies the content of jam caused on the paper sheet conveyance path 40, based on the sound collection data detected by the sound collecting microphone 7. Here, the CPU 51 when executing this processing corresponds to an abnormality specifying portion.

Specifically, the EEPROM 54 has stored therein, in advance, abnormality correspondence information indicating the correspondence relationships between the contents of a plurality of types of jams that can occur in the multifunction peripheral 10, and the contents of conveyance sounds (hereinafter, referred to as "jam sound data") detected by the sound collecting microphone 7 when the respective types of jams have occurred. Here, the EEPROM 54 is an example of an abnormality correspondence information storage portion. The CPU 51 specifies the content of jam caused on the paper sheet conveyance path 40 in accordance with the abnormality correspondence information stored in the EEPROM 54 and the sound collection data detected by the sound collecting microphone 7. Here, with reference to FIG. 4, a specific example of a method for specifying the content of jam will be described.

Figure 4A:
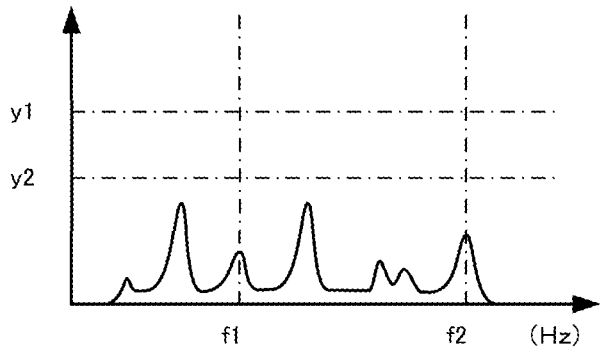
FIGS. 4A to 4C are diagrams showing examples of the content of conveyance sound caused when sheet conveyance abnormality has occurred, in the multifunction peripheral according to an embodiment of the present disclosure.
Figure 4B:
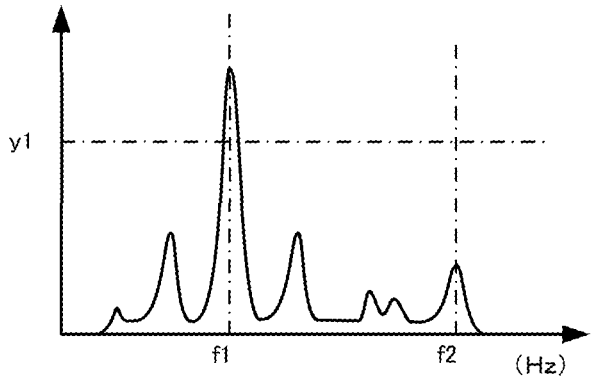
Figure 4C:
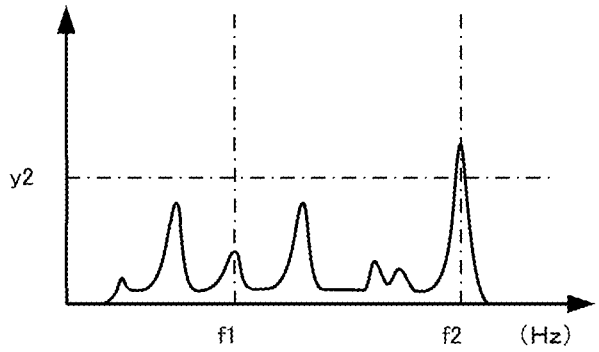

Here, FIG. 4 is a diagram showing examples of the content of the normal conveyance sound data and the content of the jam sound data. FIG. 4A shows a result of Fourier transform of the normal conveyance sound data, and FIGS. 4B and 4C show examples of a result of Fourier transform of the sound collection data when jam has occurred.

As shown in FIG. 4A, according to the result of Fourier transform of the normal conveyance sound data, the value of a frequency component of a specific frequency f1 is smaller than a threshold value y1, and the value of a frequency component of a specific frequency f2 is smaller than a threshold value y2. On the other hand, in the case where a specific type of jam has occurred, according to a result of Fourier transform of the sound collection data obtained in this case, the value of the frequency component of the specific frequency f1 is equal to or greater than the threshold value y1 as shown in FIG. 4B. In addition, in the case where another type of jam has occurred, according to a result of Fourier transform of the sound collection data obtained in this case, the value of the frequency component of the specific frequency f2 is equal to or greater than the threshold value y2 as shown in FIG. 4C.

Accordingly, in the abnormality correspondence information, the contents of results of Fourier transform of the jam sound data detected by the sound collecting microphone 7 when each jam has occurred are stored being associated with the respective contents of jams that can occur in the multifunction peripheral 10. For example, in the abnormality correspondence information, as shown in the following Table 1, it is prescribed that if the content of the sound collection data indicates that "level of frequency f1 is equal to or greater than threshold value y1", the content of jam is "jam with deformation of paper sheet T into corrugated shape". In addition, in the abnormality correspondence information, as shown in the following Table 1, it is prescribed that if the content of the sound collection data indicates that "level of frequency f2 is equal to or greater than threshold value y2", the content of jam is "jam with formation of fold on paper sheet T".

TABLE 1

| Content of jam | Jam sound data |
|---|---|
| Jam with deformation of paper sheet into corrugated shape | Level of frequency f1 is equal to or greater than threshold value y1. |
| Jam with formation of fold on paper sheet | Level of frequency f2 is equal to or greater than threshold value y2. |
| * | * |
| * | * |
| * | * |

In the multifunction peripheral 10, since the abnormality correspondence information thus set is stored in advance in the EEPROM 54, the CPU 51 can specify the content of jam caused in the multifunction peripheral 10. That is, in the multifunction peripheral 10, the content of jam caused on the paper sheet conveyance path 40 is automatically specified based on conveyance sound of a paper sheet T on the paper sheet conveyance path 40 and the abnormality correspondence information, without confirmation work by a user. It is noted that although the case where the content of jam is specified based on a result of Fourier transform of the sound collection data has been described as an example here, the specifying method is not limited thereto.

For example, it is conceivable that in the abnormality correspondence information, the waveforms of the jam sound data are stored being associated with the respective contents of jams. In this case, it is conceivable that in step S5, the CPU 51 specifies the content of jam based on the waveform of the jam sound data and the waveform of the sound collection data detected by the sound collecting microphone 7. It is noted that as a method for comparison between the waveform of the jam sound data and the waveform of the sound collection data, various conventional methods such as a method using image processing may be employed.

[Step S6]

In step S6 and the subsequent steps, the CPU 51 executes abnormality coping processing (steps S8, S62, and S63) set in advance for each content of jam, in accordance with the content of jam specified in step S5. Thus, different coping processes according to the respective contents of jams can be automatically executed. Here, the CPU 51 executing such processing corresponds to an abnormality coping portion.

First, in step S6, the CPU 51 determines whether or not the content of jam specified in step S5 is jam with deformation of the paper sheet T. For example, as jam with deformation of a paper sheet T, jam with deformation of a paper sheet T into a corrugated shape, jam with tear of paper, or the like is set in advance. On the other hand, for example, jam with sliding, multi feed, or the like of a paper sheet T is set as jam with no deformation of paper. It is noted that information thus set for each content of jam about whether or not the jam is accompanied by deformation of a paper sheet T, is stored in advance in the EEPROM 54 or the like, together with the abnormality correspondence information.

Here, if the CPU 51 has determined that the content of jam is not jam with deformation of the paper sheet T (No in S6), the CPU 51 shifts the process to step S7. On the other hand, if the CPU 51 has determined that the content of jam is jam with deformation of the paper sheet T (Yes in S6), the CPU 51 shifts the process to step S61.

[Step S7]

In step S7, the CPU 51 determines whether or not the paper sheet T on the paper sheet conveyance path 40 is in a state before transfer of a toner image thereon by the image forming portion 3. Specifically, the CPU 51 determines whether or not a toner image has been transferred onto the paper sheet T, based on elapsed time from the start of paper feed in step S1, or the like. In addition, the CPU 51 can also determine whether or not a toner image has been transferred onto the paper sheet T, based on a result of detection by a sheet detection portion such as a registration sensor (not shown) provided in the image forming portion 3.

Here, if the CPU 51 has determined that the paper sheet T is in a state before transfer of a toner image (Yes in S7), the CPU 51 shifts the process to step S8. On the other hand, if the CPU 51 has determined that the paper sheet T is in a state after transfer of a toner image (No in S7), the CPU 51 shifts the process to step S62.

[Step S8]

In step S8, the CPU 51 reversely drives the conveying roller 44 to convey the paper sheet T on the paper sheet conveyance path 40 to the feed source (the sheet feed cassette 41 or 42, the manual feed tray 43, or the like) where the paper sheet has been taken out. Thus, the paper sheet T on the paper sheet conveyance path 40 is returned to the sheet feed cassette 41 or 42 or the manual feed tray 43. After execution of step S8, the CPU 51 returns the process to step S1, to start newly feeding the paper sheet T from the sheet feed cassette 41 or 42 or the manual feed tray 43. Therefore, in the multifunction peripheral 10, even if jam has occurred, if a paper sheet T is not deformed and a toner image has not been transferred thereon yet, image forming processing corresponding to the job request can be executed again, using the paper sheet T, without treatment for jam release by a user.

[Step S61]

On the other hand, in step S61, the CPU 51 determines whether or not the content of jam specified in step S5 is jam of a type set in advance as jam that allows conveyance of the paper sheet T. For example, as jam that allows conveyance of a paper sheet T, jam with formation of folded portion on a paper sheet T, jam with multi feed in which paper sheets T are conveyed in an overlapping manner, jam with formation of only one concave-convex portion as a corrugated shape on a paper sheet T, or the like is set in advance. On the other hand, for example, jam with formation of two or three or more concave-convex portions as a corrugated shape on a paper sheet T, jam with tear of a paper sheet T, or the like is set as jam that does not allow conveyance of a paper sheet T. It is noted that information thus set for each content of jam about whether or not a paper sheet T can be conveyed, is stored in advance in the EEPROM 54 or the like, together with the abnormality correspondence information.

Here, if the CPU 51 has determined that the content of jam is jam that allows conveyance of the paper sheet T (Yes in S61), the CPU 51 shifts the process to step S62. On the other hand, if the CPU 51 has determined that the content of jam is not jam that allows conveyance of the paper sheet T (No in S61), the CPU 51 shifts the process to step S63.

[Step S62]

In step S62, the CPU 51 reversely drives the conveying roller 44 and switches the conveyance destination of the paper sheet T to the jam sheet discharge tray 47 by the conveyance switching portion 49. Thus, the paper sheet T on the paper sheet conveyance path 40 is conveyed to the jam sheet discharge tray 47. After execution of step S62, the CPU 51 returns the process to step S1, to start feeding a new paper sheet T from the sheet feed cassette 41 or 42 or the manual feed tray 43.

Therefore, in the multifunction peripheral 10, even if jam has occurred so that a paper sheet T has deformed, if the paper sheet T can be conveyed, the paper sheet T can be discharged to the jam sheet discharge tray 47, without treatment for jam release by a user. Further, since a new paper sheet T is fed from the sheet feed cassette 41 or 42 or the manual feed tray 43 without work by a user, the image forming processing corresponding to the job request is successively executed. It is noted that as another embodiment, it is conceivable that the jam sheet discharge tray 47 is omitted and one of the sheet feed cassettes 41 and 42 is used as a dedicated cassette for the discharge destination of a paper sheet T when jam has occurred.

As in the multifunction peripheral 10, in the case where two sheet discharge trays 45 and 46 are provided, it is conceivable that one of them is used as a discharge destination for normal execution of image forming processing and the other one is used as a discharge destination of a paper sheet T when jam has occurred, similarly to the jam sheet discharge tray 47. Specifically, in step S62, the CPU 51 forward drives the conveying roller 44 and switches the conveyance destination of the paper sheet T to the sheet discharge tray 46 by the conveyance switching portion 48, whereby the paper sheet T is discharged to the sheet discharge tray 46.

Further, it is conceivable that in step S62, if the jam has occurred after transfer of a toner image, the CPU 51 discharges the paper sheet T to the sheet discharge tray 46, and if the jam has occurred before transfer of a toner image, the CPU 51 discharges the paper sheet T to the jam sheet discharge tray 47. Thus, a toner can be prevented from adhering on the upstream side in the paper sheet conveyance direction on the paper sheet conveyance path 40 relative to the image forming portion 3. As a matter of course, a cleaning member that removes a toner from a paper sheet T may be provided on the upstream side in the paper sheet conveyance direction on the paper sheet conveyance path 40 relative to the image forming portion 3, and a paper sheet T having the toner image transferred thereon may be discharged to the jam sheet discharge tray 47.

[Step S63]

On the other hand, if the content of jam is not jam that allows conveyance of the paper sheet T (No in S61), in the subsequent step S63, the CPU 51 stops the conveying roller 44 to stop conveyance of the paper sheet T on the paper sheet conveyance path 40, thus ending the paper sheet conveyance processing. Thus, in the paper sheet conveyance processing, based on the sound collection data detected by the sound collecting microphone 7, occurrence of jam is detected, the content of jam is specified, and processing corresponding to the content of jam is executed.

Therefore, according to the multifunction peripheral 10, necessity of stopping conveyance can be determined at a stage earlier than in the case of conventional method which detects occurrence of jam by a pass timing of a paper sheet T, whereby the degree of deformation of a paper sheet T can be prevented from becoming significant. Here, it is conceivable that in step S63, the CPU 51 causes the operation display portion 6 to perform processing such as providing an error display indicating that jam has occurred and indicating the content of jam. This allows a user, a service person, or the like to recognize the content of jam. Here, the CPU 51 executing this processing corresponds to an abnormality notifying portion.

As described above, in the multifunction peripheral 10, the content of jam caused on the paper sheet conveyance path 40 can be specified based on sound collection data detected by the sound collecting microphone 7. Therefore, for example, it becomes possible to execute different processes depending on the content of jam caused on the paper sheet conveyance path 40. Specifically, in the multifunction peripheral 10, one of processing of returning a paper sheet T to the sheet feed cassette 41 or 42 or the manual feed tray 43, processing of discharging a paper sheet T to the jam sheet discharge tray 47, and processing of stopping feeding a paper sheet T, is selectively executed in accordance with the content of jam.

Thus, for some of the contents of jam, it is possible to release jam to restart conveying a paper sheet T without treatment by a user. In addition, since whether or not jam has occurred and the content of jam are determined based on sound collection data detected by the sound collecting microphone 7, a time lag from occurrence of jam to detection of the jam can be suppressed as compared to the conventional method, whereby the state of jam can be prevented from becoming significant. For example, when jam has occurred with deformation of a paper sheet T into a corrugated shape, the conveying rollers 44 can be stopped at a stage when the number of concave-convex portions as a corrugated shape is small. Further, according to the multifunction peripheral 10, unlike the conventional method which detects jam based on a pass timing of a paper sheet T, it is also possible to detect occurrence of minor abnormality such as sliding of a paper sheet T from a sliding sound of the paper sheet T, and notify a user of a possibility of occurrence of magnification difference or the like.

In the above embodiment, the case where jam sound data that will occur when jam occurs is stored in the EEPROM 54 in advance as information that allows identification of the contents of jams that can occur in the multifunction peripheral 10, has been described. On the other hand, it is conceivable that in the multifunction peripheral 10, the CPU 51 has a learning function of storing, as the jam sound data, sound collection data detected by the sound collecting microphone 7 into the EEPROM 54, as necessary. It is noted that in the case where the jam sound data has been already stored in the EEPROM 54, the CPU 51 overwrites the jam sound data.

More specifically, in the case where jam has occurred in the multifunction peripheral 10, the CPU 51 stores, into the EEPROM 54, sound collection data detected by the sound collecting microphone 7 when the jam has occurred, as jam sound data that allows identification of the content of the jam. For example, the multifunction peripheral 10 is provided with one or a plurality of sheet pass detection sensors that can detect a pass timing of a paper sheet T on the paper sheet conveyance path 40. In this case, in accordance with a result of detection by the sheet pass detection sensor, if a paper sheet T is not detected at a predetermined timing, the CPU 51 determines that a stuffed state with a paper sheet has occurred.

Then, when the stuffed state with a paper sheet has occurred, the CPU 51 stores, into the EEPROM 54, sound collection data detected by the sound collecting microphone 7 just before the occurrence, as jam sound data corresponding to a stuffed state with a paper sheet. On the other hand, if a time during which a paper sheet T is being detected by the sheet pass detection sensor is longer than a time set in advance in accordance with the size of the paper sheet T, the CPU 51 determines that jam referred to as multi feed in which paper sheets T are conveyed in series has occurred. Also in this case, similarly, when the multi feed has occurred, the CPU 51 stores, into the EEPROM 54, sound collection data detected by the sound collecting microphone 7 just before the occurrence, as jam sound data corresponding to multi feed.

Thus, the CPU 51 can accurately specify the content of jam, based on sound collection data detected by the sound collecting microphone 7 when jam has actually occurred in the multifunction peripheral 10, and the jam sound data stored in the EEPROM 54.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A paper sheet conveying apparatus comprising:

a paper sheet conveyance path through which a paper sheet is conveyed;

a conveyance sound detection portion that detects a conveyance sound of the paper sheet on the paper sheet conveyance path;

a control portion that starts sampling the conveyance sound of the paper sheet on the paper sheet conveyance path and stores sampled sound as conveyance sound data, the conveyance sound data including data indicating at least one of a volume, a wave form, and a result of a Fourier transform of the conveyance sound;

a control portion that sequentially compares the conveyance sound data with normal conveyance sound data that is stored in advance, to determine whether or not noise is included in the conveyance sound data, and that has a learning function of overwriting the normal conveyance sound data with the conveyance sound data as new normal conveyance sound data;

an abnormality correspondence information storage portion having stored therein abnormality correspondence information indicating correspondence relationships between contents of a plurality of types of sheet conveyance abnormalities that can occur on the paper sheet conveyance path, and contents of the conveyance sound detected by the conveyance sound detection portion when the respective sheet conveyance abnormalities occur;

an abnormality specifying portion that specifies the content of the sheet conveyance abnormality that has occurred on the paper sheet conveyance path, in accordance with the abnormality correspondence information stored in the abnormality correspondence information storage portion and the conveyance sound detected by the conveyance sound detection portion; and an abnormality coping portion that executes an abnormality coping processing set in advance for each of the contents of the sheet conveyance abnormalities, in accordance with the content of the sheet conveyance abnormality specified by the abnormality specifying portion.

2. The paper sheet conveying apparatus according to claim 1, wherein the contents of the sheet conveyance abnormalities include one or more of deformation of a paper sheet into a corrugated shape, oblique conveyance of a paper sheet, occurrence of folded portion on a paper sheet, tear of a paper sheet, conveyance of paper sheets in an overlapping manner, and occurrence of sliding of a paper sheet.

3. The paper sheet conveying apparatus according to claim 2, wherein the abnormality coping portion, when the content of the sheet conveyance abnormality is a predetermined content that allows conveyance of a paper sheet, conveys the paper sheet on the paper sheet conveyance path, to a predetermined discharge destination.

4. The paper sheet conveying apparatus according to claim 3, further comprising a sheet feed cassette on which paper sheets are stacked, wherein the abnormality coping portion, after conveying the paper sheet to the discharge destination, re-executes conveyance of a new paper sheet from the sheet feed cassette.

5. The paper sheet conveying apparatus according to claim 1, wherein the abnormality coping portion, when the content of the sheet conveyance abnormality is a predetermined content that does not allow conveyance of a paper sheet, stops conveyance of the paper sheet on the paper sheet conveyance path.

6. The paper sheet conveying apparatus according to claim 1, further comprising an abnormality notifying portion that provides a notification of the content of the sheet conveyance abnormality specified by the abnormality specifying portion.

7. An image forming apparatus comprising:

a paper sheet conveyance path through which a paper sheet is conveyed;

a conveyance sound detection portion that detects a conveyance sound of the paper sheet on the paper sheet conveyance path;

a control portion that starts sampling the conveyance sound of the paper sheet on the paper sheet conveyance path and stores sampled sound as conveyance sound data, the conveyance sound data including data indicating at least one of a volume, a wave form, and a result of a Fourier transform of the conveyance sound;

a control portion that sequentially compares the conveyance sound data with normal conveyance sound data that is stored in advance, to determine whether or not noise is included in the conveyance sound data, and that has a learning function of overwriting the normal conveyance sound data with the conveyance sound data as new normal conveyance sound data;

an abnormality correspondence information storage portion having stored therein abnormality correspondence information indicating correspondence relationships between contents of a plurality of types of sheet conveyance abnormalities that can occur on the paper sheet conveyance path, and contents of the conveyance sounds detected by the conveyance sound detection portion when the respective sheet conveyance abnormalities occur;

an abnormality specifying portion that specifies the content of the sheet conveyance abnormality that has occurred on the paper sheet conveyance path, in accordance with the abnormality correspondence information stored in the abnormality correspondence information storage portion and the conveyance sound detected by the conveyance sound detection portion; and an image forming portion that forms an image on the paper sheet fed from the paper sheet conveyance path.

8. The image forming apparatus according to claim 7, further comprising an abnormality coping portion that executes an abnormality coping processing set in advance for each of the contents of the sheet conveyance abnormalities, in accordance with the content of the sheet conveyance abnormality specified by the abnormality specifying portion.

9. The image forming apparatus according to claim 8, wherein the contents of the sheet conveyance abnormalities include one or more of deformation of the paper sheet into a corrugated shape, oblique conveyance of the paper sheet, occurrence of folded portion on the paper sheet, tear of the paper sheet, conveyance of the paper sheet and another paper sheet in an overlapping manner, and occurrence of sliding of the paper sheet.

10. The image forming apparatus according to claim 9, wherein the abnormality coping portion, when the content of the sheet conveyance abnormality is a predetermined content that allows conveyance of the paper sheet and conveys the paper sheet on the paper sheet conveyance path to a predetermined discharge destination.

11. The image forming apparatus according to claim 10, further comprising a sheet feed cassette on which paper sheets are stacked, wherein the abnormality coping portion, after conveying the paper sheet to the discharge destination, re-executes conveyance of a new paper sheet from the sheet feed cassette.

12. The image forming apparatus according to claim 8, wherein the abnormality coping portion, when the content of the sheet conveyance abnormality is a predetermined content that does not allow conveyance of the paper sheet, stops conveyance of the paper sheet on the paper sheet conveyance path.

13. The image forming apparatus according to claim 7, further comprising an abnormality notifying portion that provides a notification of the content of the sheet conveyance abnormality specified by the abnormality specifying portion.

* * * * *